United States Patent [19]
Biggar, III
[11] 4,078,490
[45] Mar. 14, 1978

[54] REGISTRATION UNIT FOR PRINTING OR COLLATING APPARATUS

[75] Inventor: Frank M. Biggar, III, Angola, N.Y.
[73] Assignee: Frank M. Biggar, Jr., Hamburg, N.Y.

[21] Appl. No.: 755,613
[22] Filed: Dec. 29, 1976

Related U.S. Application Data

[63] Continuation-in-part of Ser. No. 710,143, Jul. 30, 1976.

[51] Int. Cl.[2] ..... B41F 13/12
[52] U.S. Cl. ..... 101/248; 270/4
[58] Field of Search ..... 101/181, 248; 74/395; 270/1, 4, 5, 71; 83/298, 301; 226/27, 30

[56] References Cited

U.S. PATENT DOCUMENTS

| | | | |
|---|---|---|---|
| 1,305,891 | 6/1919 | Flick | 101/248 |
| 1,951,536 | 3/1934 | Swift, Jr. | 74/395 |
| 2,030,027 | 2/1936 | Greenwood | 74/395 |
| 2,030,028 | 2/1936 | Greenwood | 74/395 |
| 2,141,101 | 12/1938 | Webster | 74/395 |
| 2,163,035 | 6/1939 | Grupe | 101/248 |
| 2,174,728 | 10/1939 | Potdevin | 101/248 |
| 2,660,115 | 11/1953 | Ras | 101/248 |
| 3,026,798 | 3/1962 | Frostad | 101/248 |
| 3,762,698 | 10/1973 | Thomas | 270/20 |

FOREIGN PATENT DOCUMENTS

| | | | |
|---|---|---|---|
| 1,056,677 | 3/1955 | France | 101/248 |
| 2,160,416 | 6/1973 | Germany | 101/248 |
| 594,261 | 11/1947 | United Kingdom | 101/248 |

*Primary Examiner*—J. Reed Fisher
*Attorney, Agent, or Firm*—Rogers, Eilers & Howell

[57] ABSTRACT

In an apparatus such as a printing press or collator for performing operations such as printing, perforating, punching, die cutting, crimping and the like on a continuous paper web, a registration unit for particular use in a crimping and tractor station and for changing the phase index of a shaft relative to the web where said shaft is rotatably mounted between parallel frame members of said crimping and tractor station or unit, the registration unit having a sleeve rotatably mounted about the shaft with a sleeve gear drive mounted thereto and rotatable therewith. A second gear drive member is mounted to the sleeve and concentric with the sleeve gear drive for rotation therewith, said sleeve gear drive providing a drive means for rotatably driving said shaft. A motor drive and gear assembly is mounted to said shaft outboard of said frame and inboard of said sleeve for rotation with said shaft and is in engagement with said second gear drive member for selectively rotating said shaft relative to said sleeve, whereby relative rotation of said second gear drive member and shaft produces rotation of said shaft relative to said sleeve and sleeve gear drive. In one aspect of the invention each tractor and crimper shaft is drivingly interconnected, with a registration unit provided for each shaft, thus providing selective phase indexing of each shaft relative to the web.

10 Claims, 5 Drawing Figures

REGISTRATION UNIT FOR PRINTING OR COLLATING APPARATUS

BACKGROUND AND SUMMARY OF THE INVENTION

This application is a continuation-in-part of U.S. patent application Ser. No. 710,143 filed July 30, 1976.

This invention generally relates to a registration unit for use in apparatus such as printing presses or collators and more specifically one for use with a tractor or crimping station, although its unique design could be useful in other operations performed on a continuous paper web. Generally, each units are for registering the phase or angular displacement of a shaft relative to the web so that the crimping, tractor or other operation can be performed at a selected and precise location on the traveling web. Another way to view the function of the registration unit is that it registers the phase or angular displacement of one shaft relative to another in a particular web operation. Fro example, in a tractor and crimper station it registers the phase of one shaft, such as a tractor shaft, relative to another shaft, such as a crimper shaft or another tractor shaft, or both. In this way two or more tractor units can be selectively registered, or a tractor unit can be selectively registered to a crimper unit, and so on. Thus, while the importance of proper registration is well recognized in the art, generally it is to insure that each operation is performed on the traveling paper web at precisely the proper time in relation to the other operations.

Generally, registration units are known in the art. For example, U.S. Pat. No. 3,762,698 issued Oct. 2, 1973, and assigned to the same assignee as the present application, discloses a registration unit of which the present unit is an improvement. The drive connection or registration unit of the referenced patent is specifically for phase registration of a fanfolding machine with the traveling web and includes an electric motor and worm drive mounted on a shaft inboard of the folder frame, said shaft extending through the frame and having an output gear mounted thereto on the outboard side of the frame. Power is transmitted from the shaft to the output gear through the motor driven gear assembly, and actuation of the motor causes angular displacement of the output gear relative to the shaft and in this way precise registration of the fanfolder is accomplished.

While the unit of the referenced patent was exceptionally useful in registering the folder to the traveling web, its design with the motor and worm drive mounted inboard of the frame was found to be undesirable for other applications.

Thus, it is a primary object of the present invention to provide a registration unit where the motor and worm drive assembly is mounted outboard of the frame but inboard of the sleeve, and in a preferred embodiment where the shaft drive is mounted to the sleeve of the registration unit.

More specifically, a sleeve is rotatably mounted about a shaft outboard of the frame between which the shaft to be registered is mounted. Affixed to the sleeve or as part of the sleeve is a sleeve gear drive for driving the sleeve and shaft and a second gear drive member for registration adjustment. A motor and worm gear assembly is mounted to the shaft outboard of the frame but inboard of the sleeve and engages the second gear drive such that actuation of the motor produces rotation of the shaft relative to the second gear, sleeve, and sleeve drive gear. This arrangement is particularly useful where it is desirable to locate the sleeve and shaft drive at the outboard end of the shaft for accessibility.

Thus, it is the primary purpose of this invention to provide an improved registration unit over the type disclosed in the referenced patent and where the motor and drive unit is mounted outboard of the frame and inboard of the sleeve and shaft drive. These and other objects of the invention will become apparent from the drawing and detailed description to follow.

DETAILED DESCRIPTION OF THE PREFERRED EMBODIMENT

Figure 1:
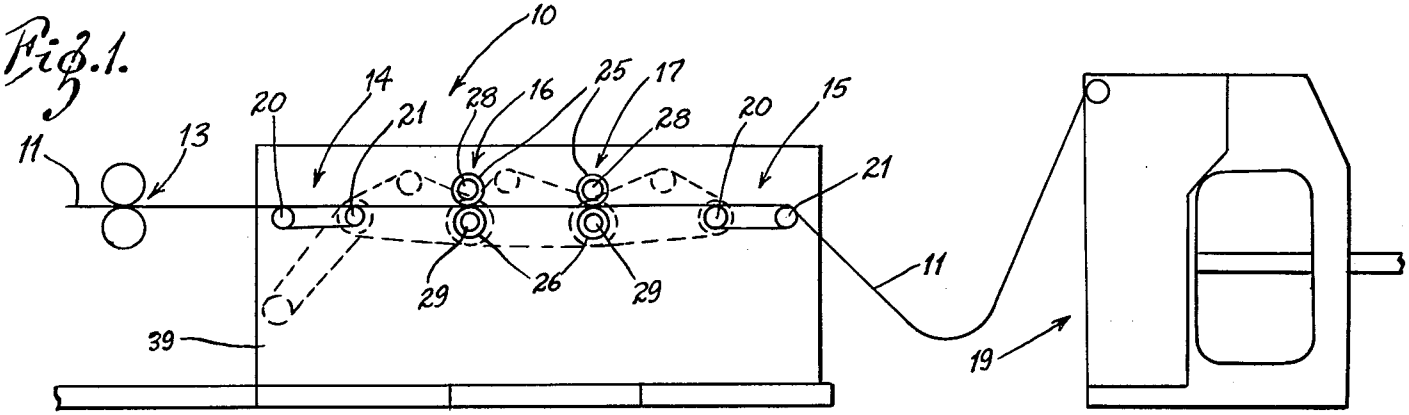
FIG. 1 is a schematic side elevation view of a portion of a collator illustrating an example of an operation for which the registration unit of this invention is used.

Referring to FIG. 1 of the drawing, there is shown an example of the type of apparatus with which the registration unit of this invention is used. Thus, there is shown a portion of a collator 10 for performing various operations on a moving paper web 11, the movement of the web being from left to right as viewed in FIG. 1. Typically, such a web is fed from an unwind unit (not shown) containing a large roll of paper, through one or more stations which might include a perforating station schematically shown at 13, tractor stations 14 and 15, crimping stations 16 and 17, and a folder 19 where the web is folded for further handling. Each of these operations is well known in the art of producing business forms, labels, and the like.

At each of the stations 14 through 17, it is necessary that the operation performed by that station be registered with the web or with the other operations so that each operation is performed on the web at precisely the proper instant of time. Since each of these operations is performed by cooperating cylinders or rollers mounted on shafts which extend between frame members, the necessary registration can be accomplished by adjustment of the phase relationship or angular displacement of each shaft relative to the traveling web. Thus, at each tractor station 14 and 15 there are shafts 20 and 21 suitably coupled such as by drive belts 23 and 24 so that the shafts 20 and 21 rotate at the same speed. Registration of each tractor unit 14 and 15 is accomplished by changing the phase of one of the shafts 20 or 21 relative to the web. At each crimping station 16 and 17 there are crimping dies 25 and 26 between which the web moves, these dies being rotatably driven by shafts 28 and 29. The shafts 28 and 29 of each crimping station are drivingly coupled by gears shown at 30 so as to rotate at the same speed. The registration of each crimping station is accomplished by changing the phase of the shafts 28 and 29 relative to the web.

Figure 2:
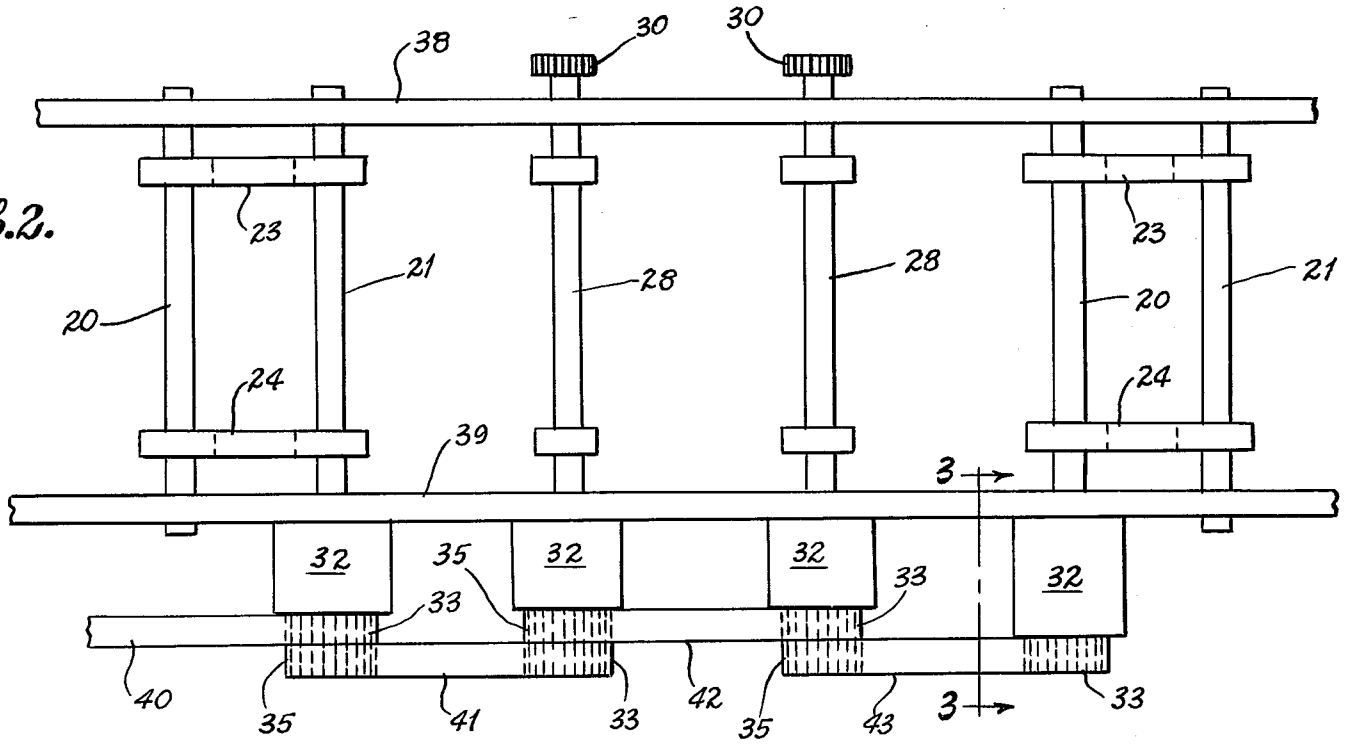
FIG. 2 is generally an enlarged top plan view of the tractor and printing station of FIG. 1.

The schematic of FIG. 2 illustrates generally how the registration unit of this invention cooperates with the shafts of the respective station to accomplish proper registration. In FIG. 2 there is shown schematically the tractor stations 14 and 15 with the shafts 20 and 21 rotatably mounted between parallel side frame members 38 and 39 of the collator 10. One of the shafts, such as the shaft 21 of the tractor unit 14 has a registration unit 32 of this invention, to be more fully described, located outboard of the frame member 39. A sleeve gear or sprocket drive 33 for driving the shafts 20 and 21 is part of the registration unit 32 and is located at the outboard end of the shaft 21. Another gear or sprocket drive 35 is mounted for rotation with the sprocket 33.

Each crimping station 16 and 17 also has a registration unit 32 connected to one of the shafts such as the shaft 29 and located outboard of the frame member 39. Each of the crimping units 16 and 17 also has a sleeve gear or sprocket drive 33 and another gear or sprocket drive 35.

The tractor unit 15 also has a registration unit 32 attached to one of the shafts such as the shaft 20, and located outboard of the frame member 39, and includes a sleeve gear or sprocket drive 33.

The tractor and crimping units are driven by a suitable drive belt 40 connected to the sleeve drive 33 of the tractor unit 14 from a suitable drive source (not shown). Additional drive belts 41, 42 and 43 drivingly interconnect the tractor and crimping stations. Additional drive belts and drive gears or sprockets may be provided for driving additional operations if desired.

The registration unit 32 will now be described in more detail with reference to FIGS. 3 through 5.

Figure 3:
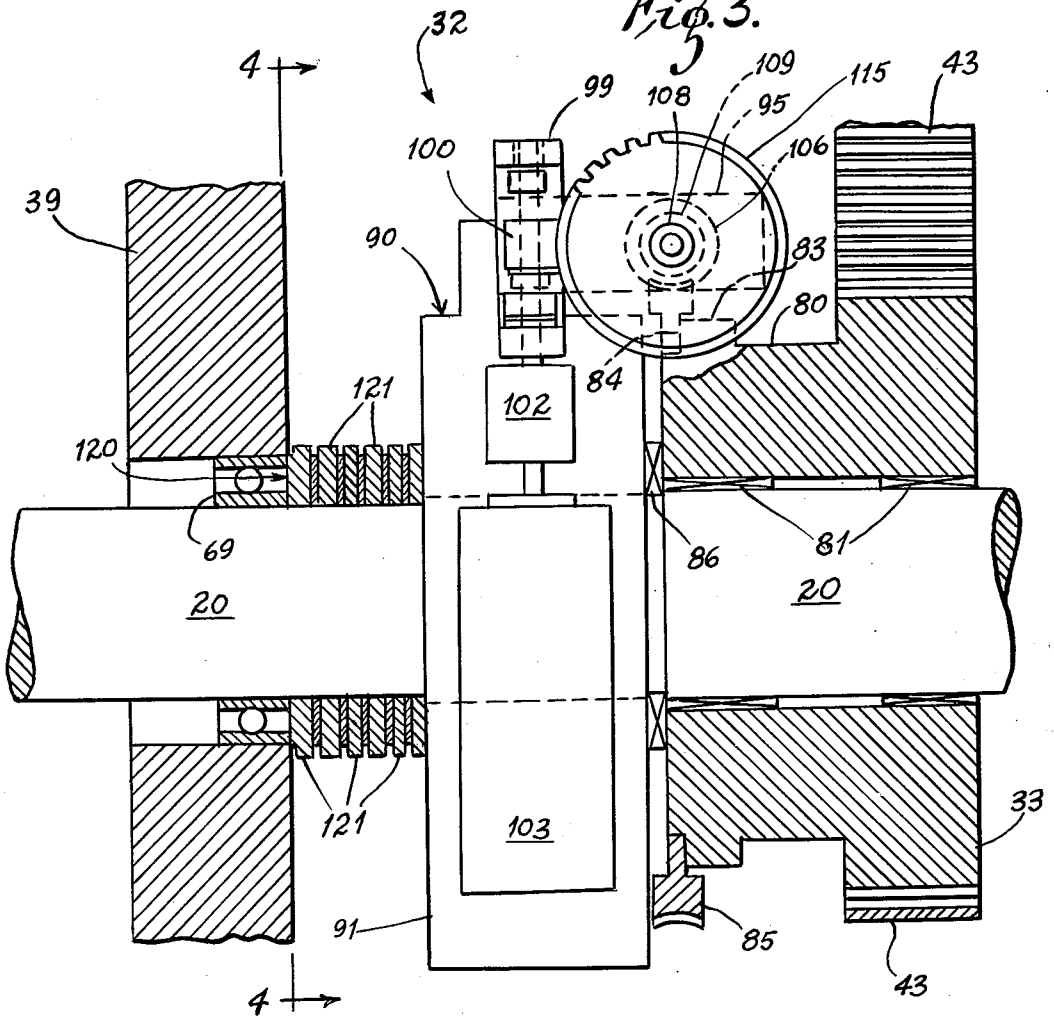
FIG. 3 is an enlarged detailed view in partial section of a registration unit portion of FIG. 2 as viewed generally along the line 3—3 of FIG. 2.
Figure 4:
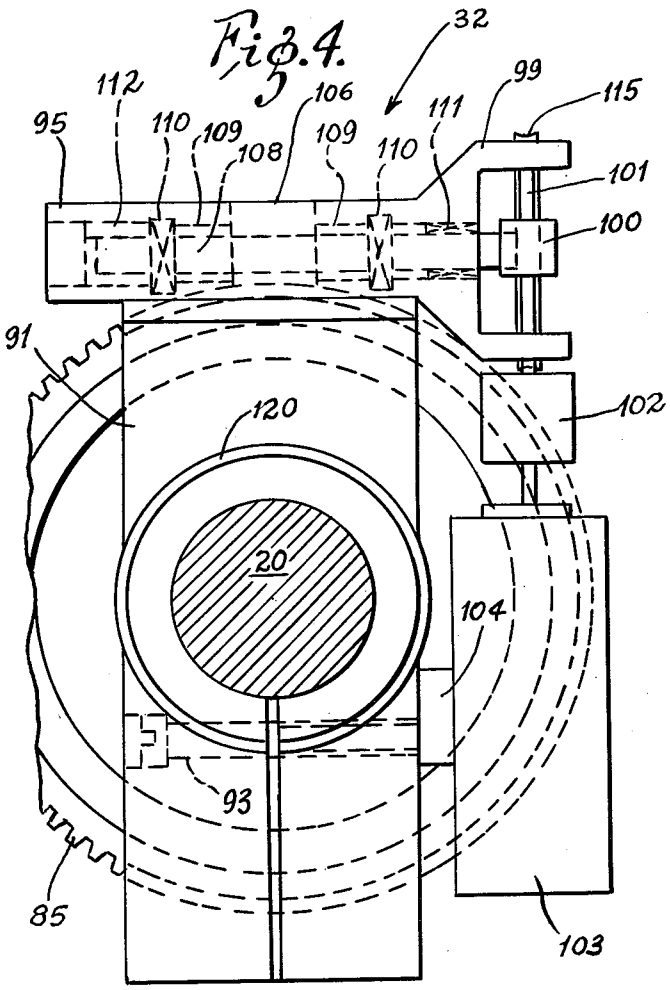
FIG. 4 is a view in section taken generally along the line 4—4 of FIG. 3.
Figure 5:
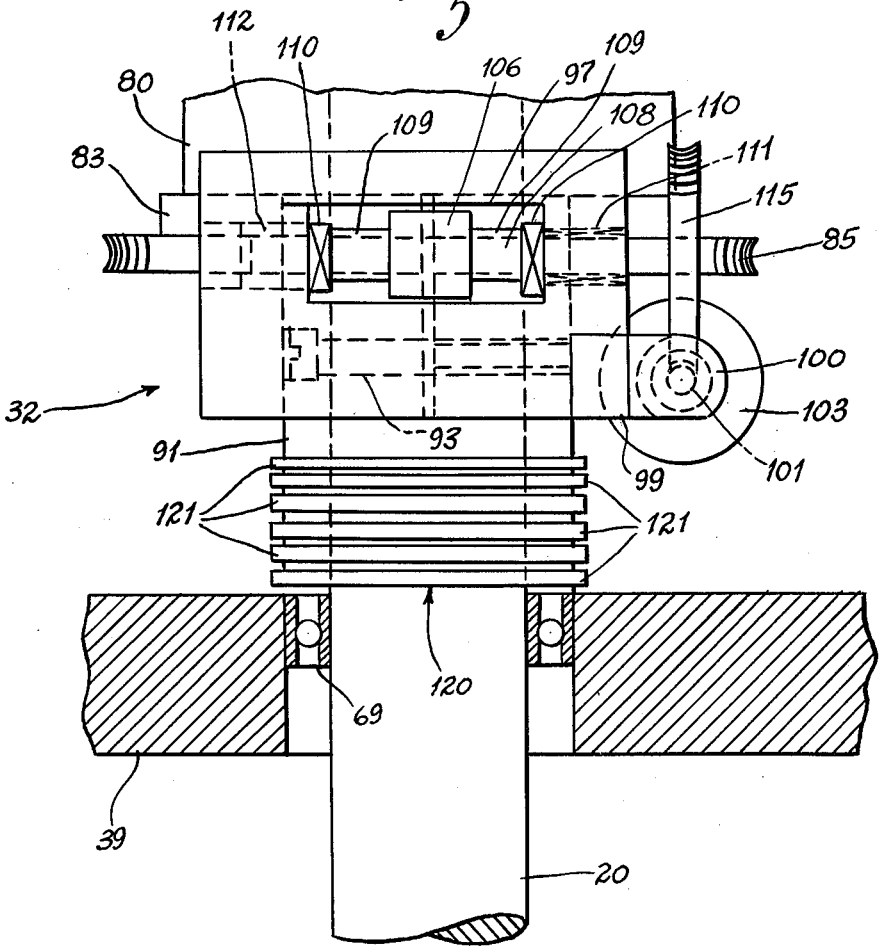
FIG. 5 is a partial plan view of FIG. 4.

In FIGS. 3 through 5 there is shown the registration unit 32 for driving the tractor unit 15 and for registering that unit to the traveling web 11. The other registration units 32 for the tractor unit 14 and crimping units 16 and 17 are the same except that an additional gear or sprocket drive 35 is provided which rotates with the sprocket 33 for drivingly interconnecting the units.

The shaft 20 of the tractor unit 15 is rotatably mounted within the frame member 39 such as by suitable bearings 69. A sleeve 80 is rotatably mounted on the shaft 20 outboard of the frame 39 by suitable bearings 81. The outer portion of the sleeve 80 is formed in the concentric sleeve gear or sprocket drive 33 which engages the drive belt 43. The inner end of the sleeve 80 is formed in an annular shoulder 83 and annular notch 84 in which is secured a concentric worm or second gear drive member 85. Suitable bearings 86 are located at the inner end of the sleeve 80.

Secured to the shaft 20 for rotation therewith inwardly of the sleeve 80, and outboard of the frame 39, is a motor drive and work gear assembly 90. The assembly 90 includes a split clamp 91 having an aperture 92 therethrough into which the end of the shaft 20 extends, the clamp 91 being securely fastened to the shaft by a suitable bolt 93 extending through the clamp at this split end as best shown in FIG. 4. A cast frame 95 is mounted at the top of the clamp 91 as depicted in the drawing by any suitable means such as bolts (not shown). The frame 95 is preferably of cast, one-piece construction and has a generally rectangular opening 97 located directly above the worm gear 85, and an ear portion 99 at an outer corner of the frame formed in a yoke. A worm 100 is mounted within the yoke 99 on a shaft 101 for rotation about a generally vertical axis. The shaft 101 is driven through a suitable coupling 102 by an electric motor 103 mounted by a suitable bracket 104 to the clamp 91.

Another worm 106 is mounted within the opening 97 to drivingly engage the worm gear 85. The worm 106 is mounted by a shaft 108, sleeves 109, bushings 110, bearings 111, and a threaded sleeve 112 shown for purposes of illustration. The threaded sleeve 112 is adjusted to load the bushings and prevent the worm 106 from moving along its axis. Other suitable means for mounting the worm 106 within the opening 97 could be used. Another worm gear 115 is secured to the end of the worm shaft 108 for rotation therewith, which gear 115 is in engagement with and driven by the worm 100.

To supply electrical power to the motor 103, a slip ring assembly 120 is secured to the shaft 20 just outboard of the frame member 39 and includes conductive rings 121 which receive electrical power from suitable brushes (not shown), and feed that power to the motor 103 by suitable conductors (not shown) for selective actuation of the electric motor either while the collator is operative or inoperative. The other registration units 32 are the same except that the shaft 20 is replaced such as by the shaft 29. Also the sleeve 80 may be provided with the additional drive gear or sprocket 35 for rotation with the sprocket 33.

OPERATION OF THE REGISTRATION UNIT

The purpose of the unit 32 is to drive either the shaft 20 or 21 of the tractor units 14 and 15, and the shaft 28 or 29 of the crimping units 16 and 17, while also allowing a phase shift or angular displacement of the shaft relative to the web, or of one shaft relative to the other shaft.

Under normal operating conditions, i.e., when the collator is operating to produce forms or the like, the sprocket 33 is driven by an appropriate one of the drive belts 40, 41, 42, and 43, which in turn drives the shaft 20 through the sleeve 80 and motor and worm gear assembly 90. Since the assembly 90 is in engagement with the sleeve 80 through the worms 100 and 106 and the worm gears 115 and 85, rotation of the sleeve 80 also imparts rotation to the shaft 20, all of which rotates about the rotating axis of the shaft.

Phase adjustment or registration is accomplished by selectively actuating the electric motor 103 through suitable controls energizing the slip ring assembly 120. Energizing the motor 103 drives the worm 100 which in turn drives the worm gear 115 and the worm 106, and which through engagement with the worm gear 85 drives the shaft 20 relative to the sleeve 80. The motor and worm gear assembly 90 constitutes a double gear reduction which provides a very fine angular adjustment of the shaft 20. The motor 103 is preferably a DC motor which can be actuated to operate in either the forward or reverse direction for angular adjustment of the shaft 20 in either direction. The angular adjustment or registration can be accomplished while the sleeve 80 is driven as during normal operation of the machine. The arrangement of the sleeve 80 at the outboard end of the shaft 20, and of the motor and worm gear assembly 90 also outboard of the frame 39 but inboard of the sleeve 80, makes the registration unit 32 uniquely suitable for ready access to the drive gear or sprockets 33 and 35.

With specific reference to the tractor and crimping unit shown in FIG. 2, each of the units 14 through 17 can be registered relative to the web and relative to each other by simple operation of the registration units 32. Thus, the tractor unit 14 is first registered with the web to engage the line holes of the web and thus provide means for driving the web toward the crimping stations 16 and 17. Next the tractor unit 15 can be registered to also engage the line holes and provide the desired amount of web tension between the two tractor units. A selected one or both of the crimping units 16 or 17 can then be registered to provide repetitive crimping of the web at selected locations along the web length. All of these registrations can be accomplished while the collator or printer is operating and without disengaging any of the drive belts 40 through 43. However, should it be desired or necessary to remove the belts or anyone or more of the shafts 20, 21, 28 and 29, this can be done with relative ease because of the outboard locations of the registration units, and the outboard locations of the shaft drives 33 and 35 associated with each registration unit.

Thus there has been described a novel registration unit where the motor drive and worm gear assembly is mounted outboard of the frame and cooperates with a rotatably mounted sleeve located outboard of the motor drive and worm gear assembly to allow phase or angular displacement adjustment of the shaft relative to the sleeve.

Various changes and modifications may be made to this invention, as will be readily apparent to those skilled in the art. Such changes and modifications are within the scope and teaching of this invention as defined by the claims appended hereto.

What is claimed is:

1. In an apparatus such as a printing press or collator for performing operations on a continuous paper web, a registration unit for changing the phase of a shaft relative to the web, said shaft rotatably mounted between parallel frame members, said registration unit comprising a sleeve rotatably mounted about said shaft outboard of said frame members and having a sleeve drive means mounted thereto and rotatably therewith, a second drive member mounted to said sleeve for rotation with said sleeve, and means mounted to said shaft for rotation therewith inboard of said sleeve and outboard of said frame members and at the same side of said frame as said sleeve and engaging said second drive member for selectively rotating said shaft relative to said sleeve.

2. The registration unit of claim 1 wherein said means mounted to said shaft and engaging said second drive member further comprises an electric motor, means for mounting said motor to said shaft for rotation therewith, slip ring means concentric and rotatable with said shaft for supplying electrical power to energize said motor, gear drive means for driving said second drive member relative to said shaft in response to rotation of said motor shaft, and means for selectively energizing said motor for selective rotational displacement of said shaft relative to said second drive member, sleeve, and sleeve drive means.

3. The registration unit of claim 2 further comprising a double reduction gear means between said motor shaft and said second drive member.

4. The registration unit of claim 3 further comprising a first worm mounted to said motor shaft for rotation therewith, a worm gear driven by said first worm, a second worm concentric with said worm gear and rotatable therewith, said second worm engaging said second drive member.

5. The registration unit of claim 4 wherein said motor is mounted to a split collar secured to said shaft inboard of said sleeve.

6. The registration unit of claim 4 further comprising a bracket mounted for rotation with said shaft, said bracket having an opening and yoke formed therein, said first worm rotatably mounted in said yoke concentric with said motor shaft, and said second worm rotatably mounted in said opening about an axis normal to the rotational axis of said first worm.

7. The registration unit of claim 1 wherein said shaft is that of a tractor unit.

8. The registration unit of claim 1 wherein said shaft is that of a crimping unit.

9. The registration unit of claim 1 wherein said sleeve drive means and said second drive member are gear means concentric with said sleeve.

10. In an apparatus such as a printing press or collator for performing operation on a continuous paper web, a registration unit for changing the phase of a shaft relative to the web, said shaft rotatably mounted between parallel frame members, said registration unit comprising a sleeve rotatably mounted about said shaft outboard of said frame members and having a sleeve gear drive means mounted thereto and rotatably therewith, a second gear drive member mounted to said sleeve inboard of said sleeve gear drive means for rotation with said sleeve, said sleeve being concentric with said shaft, and said sleeve gear drive means and second gear drive member being concentric with said sleeve, and means mounted to said shaft for rotation therewith inboard of said sleeve and outboard of said frame members and at the same side of said frame as said sleeve and engaging said second gear drive member for selectively rotating said shaft relative to said sleeve, said last named means further comprising an electric motor, means for mounting said motor to said shaft for rotation therewith at a location inboard of said sleeve and outboard of said frame members, slip ring means concentric and rotatable with said shaft and located inboard of said motor and outboard of said frame for supplying electrical power to energize said motor, gear drive means for driving said second gear drive member relative to said shaft in response to rotation of said motor shaft, and means for selectively energizing said motor for selective rotational displacement of said shaft relative to said second gear drive member, sleeve, and sleeve gear drive means.

* * * * *